US010415884B2

(12) United States Patent
Schlicht et al.

(10) Patent No.: US 10,415,884 B2
(45) Date of Patent: Sep. 17, 2019

(54) OVERFLOW MOLTEN METAL TRANSFER PUMP WITH GAS AND FLUX INJECTION

(71) Applicant: PYROTEK, INC., Solon, OH (US)

(72) Inventors: David Schlicht, Pewaukee, WI (US); Andrew Horsfall, Cuyahoga Falls, OH (US); Richard S. Henderson, Solon, OH (US); Lennard Lutes, Copley, OH (US)

(73) Assignee: PYROTEK, INC., Solon, OH (US)

( * ) Notice: Subject to any disclaimer, the term of this patent is extended or adjusted under 35 U.S.C. 154(b) by 200 days.

(21) Appl. No.: 14/891,206

(22) PCT Filed: May 14, 2014

(86) PCT No.: PCT/US2014/000108

§ 371 (c)(1),
(2) Date: Nov. 13, 2015

(87) PCT Pub. No.: WO2014/185971

PCT Pub. Date: Nov. 20, 2014

(65) Prior Publication Data

US 2016/0116216 A1 Apr. 28, 2016

Related U.S. Application Data

(60) Provisional application No. 61/823,103, filed on May 14, 2013.

(51) Int. Cl.
*F27D 3/10* (2006.01)
*F27D 3/14* (2006.01)
(Continued)

(52) U.S. Cl.
CPC ..... *F27D 3/10* (2013.01); *B22D 1/005* (2013.01); *B22D 1/007* (2013.01); *C22B 9/05* (2013.01);
(Continued)

(58) Field of Classification Search
CPC ..... B22D 1/005; B22D 1/007; C22B 9/05; C22B 9/103; F27D 19/00;
(Continued)

(56) References Cited

U.S. PATENT DOCUMENTS 4,835,701 A * 5/1989 Ohiwa ..... C22B 9/103 266/82
5,405,427 A 4/1995 Eckert
(Continued)

FOREIGN PATENT DOCUMENTS

AL 00956645 A1 12/1983

OTHER PUBLICATIONS

Extended Search Report for EP14798072.6.
(Continued)

*Primary Examiner* — Jessee R Roe
*Assistant Examiner* — Michael Aboagye
(74) *Attorney, Agent, or Firm* — Fay Sharpe LLP

(57) ABSTRACT

A method of fluxing or degassing a molten metal residing as a bath in a furnace. The bath of molten metal includes a bath surface height and the method provides at least one rotating impeller in the molten metal bath to initiate a flow of the molten metal. The flow in the molten metal results in elevating a portion of the molten metal above the bath surface height where at least one of a fluxing agent and an inert gas is introduced into the elevated portion of the molten metal.

10 Claims, 13 Drawing Sheets

(51) Int. Cl.

| | |
|---|---|
| ***F27D 21/00*** | (2006.01) |
| ***F27D 19/00*** | (2006.01) |
| ***F27D 3/08*** | (2006.01) |
| ***C22B 9/10*** | (2006.01) |
| ***C22B 9/05*** | (2006.01) |
| ***F04D 7/06*** | (2006.01) |
| ***B22D 1/00*** | (2006.01) |
| ***F27D 3/16*** | (2006.01) |
| *F27D 3/00* | (2006.01) |

(52) U.S. Cl.
CPC ..... *C22B 9/103* (2013.01); *F04D 7/065* (2013.01); *F27D 3/08* (2013.01); *F27D 3/14* (2013.01); *F27D 3/16* (2013.01); *F27D 19/00* (2013.01); *F27D 21/0028* (2013.01); *F27D 2003/0054* (2013.01); *F27D 2003/0083* (2013.01)

(58) Field of Classification Search
CPC ..... F27D 2003/0054; F27D 2003/0083; F27D 21/0028; F27D 3/08; F27D 3/10; F27D 3/14; F27D 3/16
USPC ..... 266/216, 214, 81, 235, 233, 217, 215
See application file for complete search history.

(56) References Cited

U.S. PATENT DOCUMENTS

| | | | | |
|---|---|---|---|---|
| 5,468,280 | A | 11/1995 | Areaux | |
| 6,689,310 | B1 | 2/2004 | Cooper | |
| 6,808,550 | B2 * | 10/2004 | Mahapatra | B22D 1/00 75/382 |
| 9,127,332 | B2 * | 9/2015 | Frank | C22B 9/05 |
| 2002/0185790 | A1 * | 12/2002 | Klingensmith | B22D 17/30 266/81 |
| 2008/0236336 | A1 | 10/2008 | Thut et al. | |
| 2008/0314548 | A1 | 12/2008 | Cooper | |
| 2010/0104415 | A1 * | 4/2010 | Morando | F04D 1/14 415/1 |
| 2011/0303706 | A1 | 12/2011 | Cooper | |

OTHER PUBLICATIONS

Zhang, et al., "Removal of impurity elements from molten aluminum," Min. Proc. Extr. Metall. Rev., vol. 32, pp. 150-228, 2011.
Warner, "Advanced Technology for smelting McArthur river ore," Min. Engg., vol. 2. No. 1, pp. 3-32 1989.

* cited by examiner

OVERFLOW MOLTEN METAL TRANSFER PUMP WITH GAS AND FLUX INJECTION

BACKGROUND

The present exemplary embodiment relates to a molten metal pump having gas and/or flux introduction capabilities. It finds particular application in conjunction with an overflow transfer style of pump, and will be described with particular reference thereto.

Pumps for pumping molten metal are used in furnaces in the production of metal articles. Common functions of pumps are circulation of molten metal in the furnace or transfer of molten metal to remote locations. The present description is focused on molten metal pumps for transferring metal from one location to another. It finds particular relevance to systems where molten metal is elevated from a furnace bath into a launder system.

Currently, many metal die casting facilities employ a main hearth containing the majority of the molten metal. Solid bars of metal may be periodically melted in the main hearth. A transfer pump can be located in a well adjacent the main hearth. The transfer pump draws molten metal from the well and transfers it into a ladle or conduit, and from there, to die casters that form the metal articles. The present disclosure relates to pumps used to transfer molten metal from a furnace to a die casting machine, ingot mold, or the like.

In aluminum foundries where castings are made using either high pressure die casting or gravity die casting techniques, ladles are often used for transporting pre-measured quantities of liquid metal from a holding furnace to a casting machine and then pouring the liquid metal into a receptacle of the casting machine. The ladle can be filled by using a molten metal transfer pump to move metal from the furnace to the ladle. One particular molten metal transfer pump described herein is referred to as an overflow transfer pump. For example, the overflow transfer pump in U.S. Publication No. 2013/0101424, herein incorporated by reference, is suitable.

Molten metals such as aluminum may include oxide and/or nitride debris that have a negative effect on the solidification of the particular alloy. A fluxing process is one methodology used to remove such impurities. Flux injection is the process of introducing a powdered or granulated salt mixture such as chloride and/or fluoride into the molten aluminum. Traditionally, the salt flux has been introduced by simply depositing the flux in a ladle before or during molten metal addition and/or using a rotary apparatus for introduction of the flux in the ladle or downstream from the ladle.

An exemplary rotary apparatus includes a central hollow shaft attached to a rotor inserted into a pool of molten aluminum and rotated such that the salt flux travels down the hollow shaft and is dispersed within the molten aluminum through apertures in the rotor. This style of flux injection device has proven problematic as failure to control the flow rate of the purge gas used to keep the molten metal out of the shaft during insertion into the bath can cause molten metal splash. Similarly, the high flow process gas used after insertion can cause molten metal splash. Conversely, a disruption in the gas feed line (e.g., kink or bend) has the cascade effect of allowing the flux injecting shaft/rotor assembly to become clogged with flux and/or molten metal ingress. Moreover, since the shaft/rotor assembly of the traditional device is disposed below the molten metal line, improper handling can result in hardening of metal therein, causing the device to become inoperative.

Flux addition by simple deposit in the ladle may not achieve a homogenous dispersion of the flux throughout the molten metal. Furthermore, use of a rotary fluxing apparatus in the ladle or at a downstream location introduces an undesirable time delay to the casting process.

The melted or liquefied form of aluminum also attracts the formation and absorption of hydrogen within the molten aluminum. Hydrogen evolves as porosity during the solidification of aluminum alloys and is detrimental to the mechanical properties of the solid alloy. Degassing is an effective way of reducing hydrogen caused porosity. One example of degassing involves introducing an inert gas such as argon or nitrogen into the molten aluminum to collect hydrogen and non-metallic inclusions. The gas bubbles to the surface with the hydrogen and other inclusions. Similar to fluxing, this process has been historically performed in the ladle and/or at a downstream processing station. Accordingly, undesirable time delays result.

The present disclosure is directed to a system for introducing flux and/or gas to molten metal in a highly efficient manner. Moreover, the present system is believed to provide comparable flux introduction results while improving efficiency and safety. The present disclosure is directed to an improved, more efficient introduction of flux and/or inert gas at the molten metal transfer pump, before filling of the ladle. Moreover, it has been found that a more homogenous mixture of flux within the molten metal can be achieved with introduction of small quantities of flux over time into a moving stream of metal. Similarly, it has been found that the quality of the metal can be improved by the introduction of an inert gas early in the transfer process of the metal from furnace to casting apparatus. Exemplary locations for flux/gas injection may include the column of an overflow transfer pump or the second chamber of divided chamber overflow transfer apparatus or the launder into which molten metal is directed.

SUMMARY OF THE INVENTION

Various details of the present disclosure are hereinafter summarized to provide a basic understanding. This summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter.

According to a first embodiment, a method for fluxing or degassing a molten metal residing as a bath in a furnace is provided. The bath of molten metal includes a bath surface height and the method provides at least one rotating impeller in the molten metal bath to initiate a flow of said molten metal. The flow in the molten metal results in elevating a portion of the molten metal above the bath surface height where at least one of a fluxing agent and an inert gas is introduced into the elevated portion of the molten metal.

According to a second embodiment, an apparatus for introducing flux to molten metal residing as a bath in a furnace is provided. The bath of molten metal includes a bath surface height. The apparatus includes at least one rotating impeller in the molten metal bath to initiate a flow of the molten metal, and the flow of molten metal causes elevation of at least a portion of the molten metal above the bath surface height. A device is also provided which introduces a fluxing agent to the elevated portion of the molten metal.

According to a further embodiment, an apparatus for introducing gas to molten metal residing as a bath in a furnace is provided. The bath of molten metal includes a bath surface height. The apparatus includes at least one rotating impeller in the molten metal bath to initiate a flow of the molten metal, and the flow of molten metal causes elevation of at least a portion of the molten metal above the bath surface height. A device is also provided which introduces a gas to the elevated portion of the molten metal.

BRIEF DESCRIPTION OF THE DRAWINGS

It is to be understood that the detailed figures are for purposes of illustrating the exemplary embodiments only and are not intended to be limiting. Additionally, it will be appreciated that the drawings are not to scale and that portions of certain elements may be exaggerated for the purpose of clarity and ease of illustration.

DETAILED DESCRIPTION

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

Figure 1:
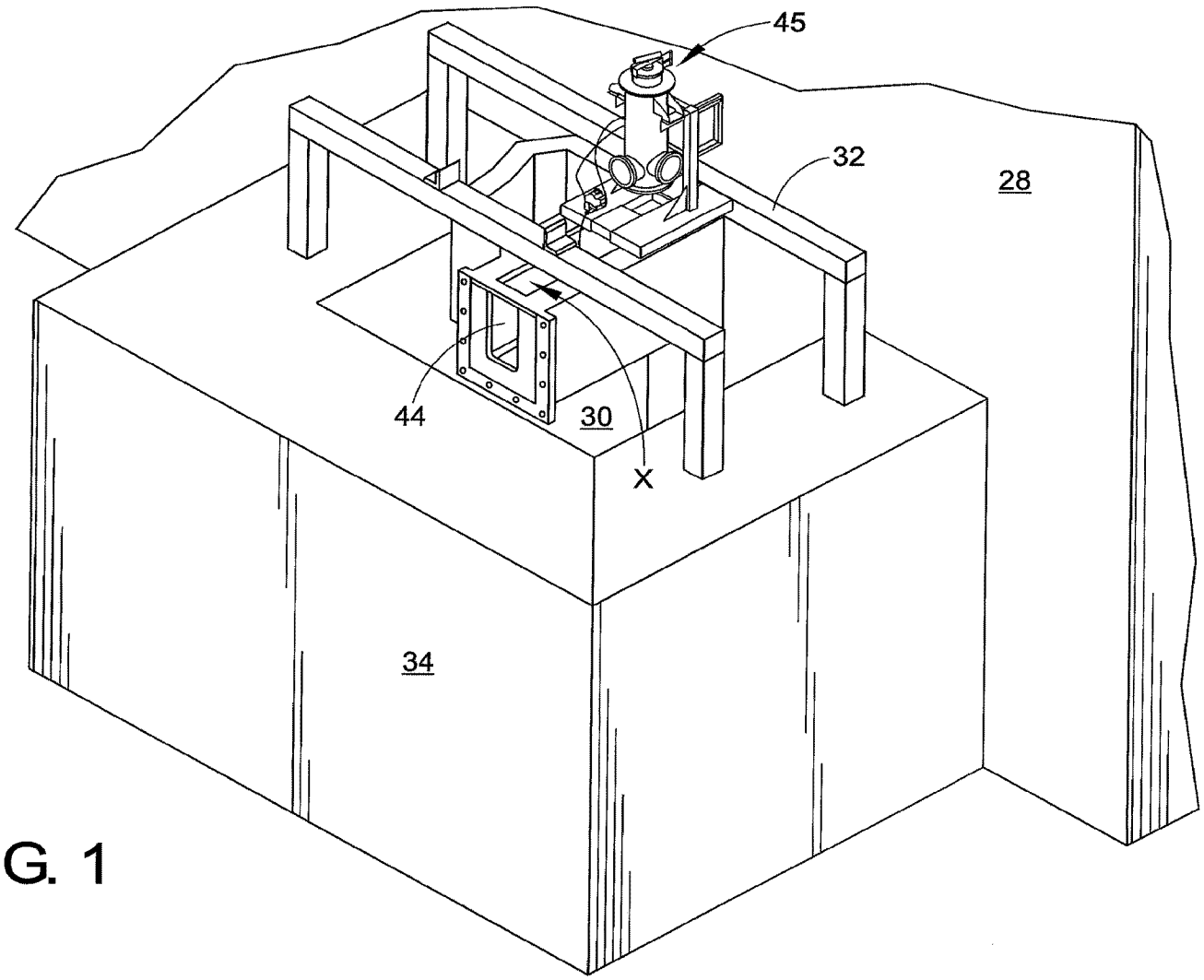
FIG. 1 is a perspective view showing a flux introduction molten metal transfer system including the pump disposed in a furnace bay.
Figure 2:
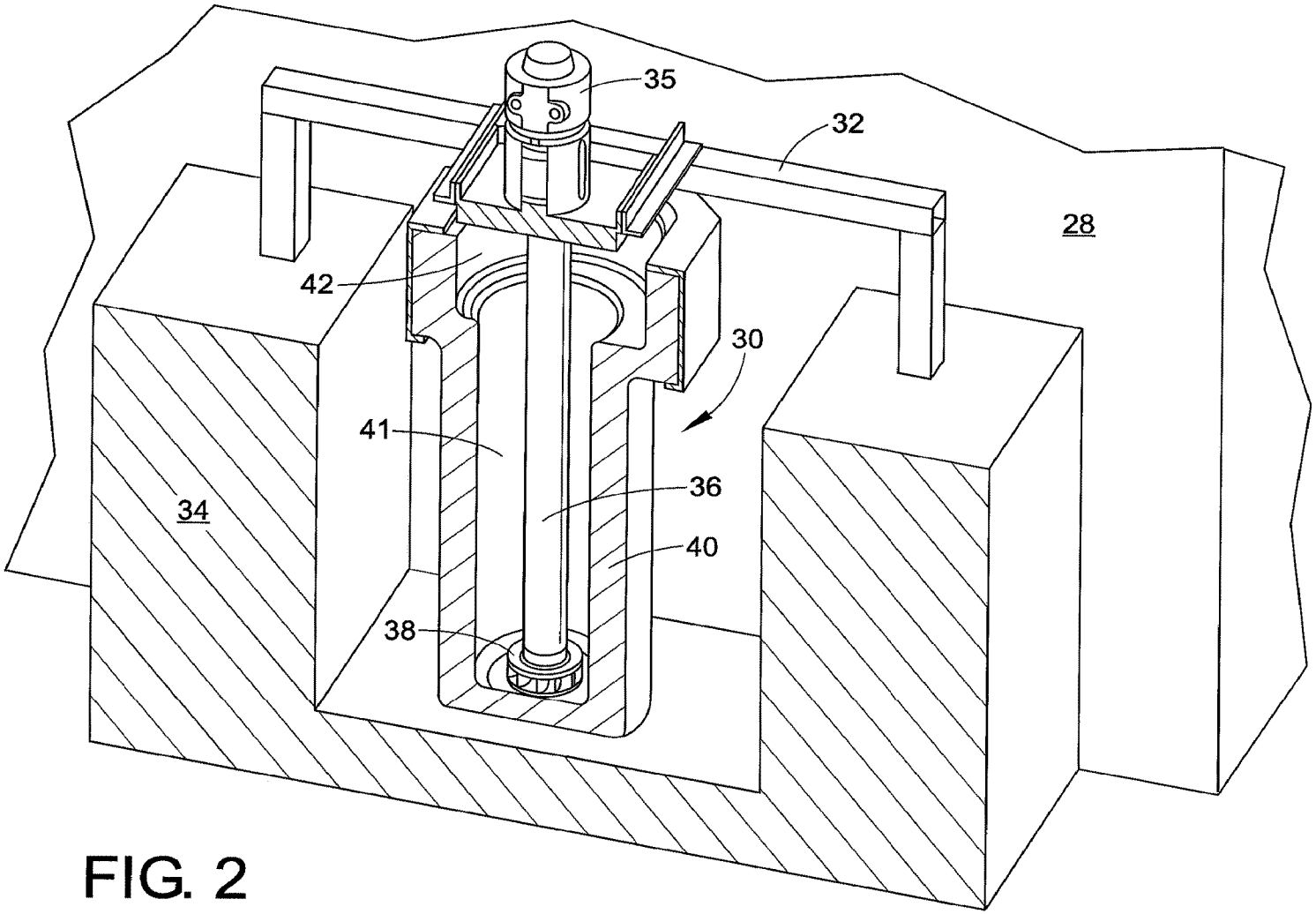
FIG. 2 is a perspective partially in cross-section view of the pump of FIG. 1.
Figure 3:
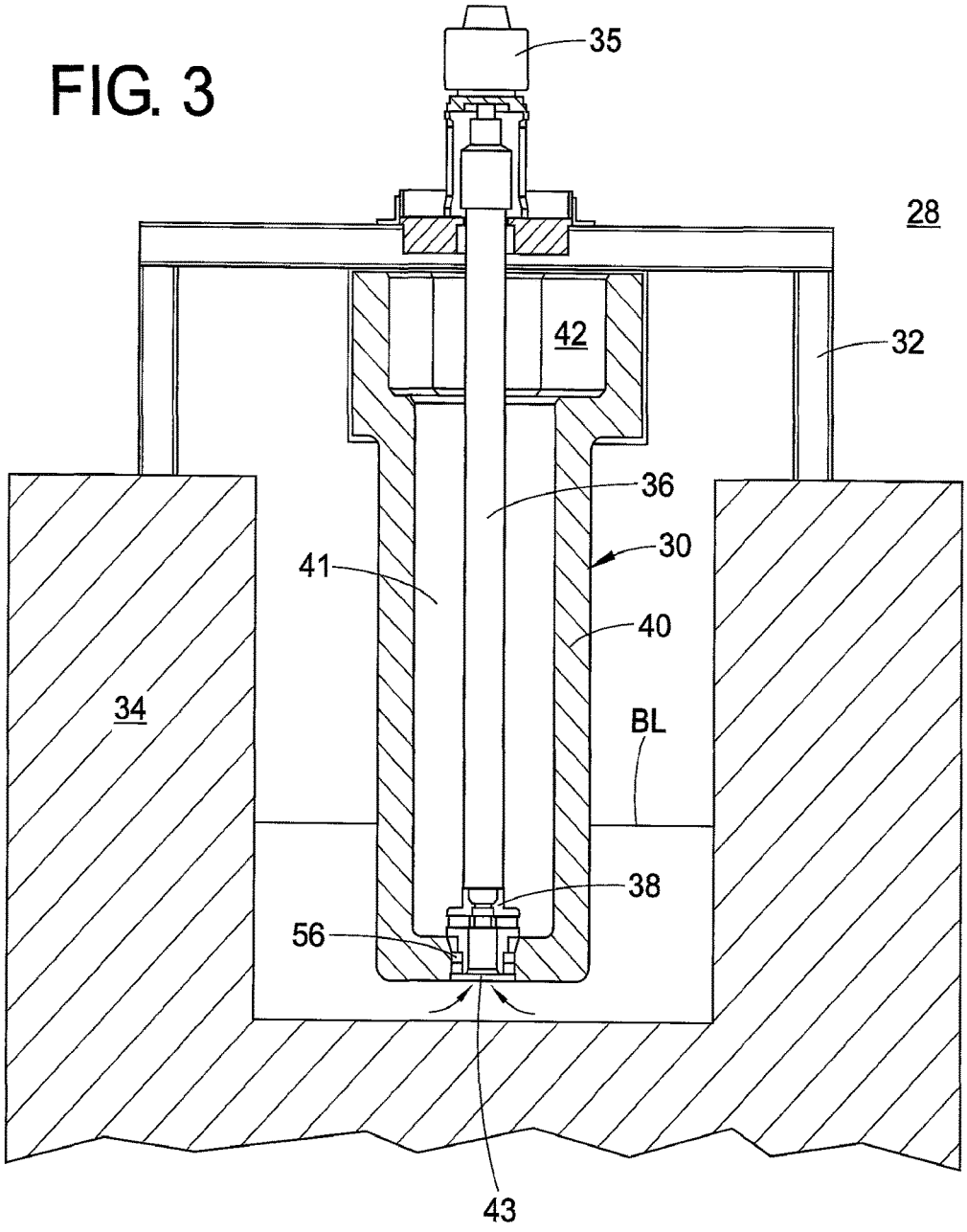
FIG. 3 is a side cross-sectional view of the pump shown in FIGS. 1 and 2.

With reference to FIGS. 1-3, a molten metal pump 30 is depicted in association with a furnace 28. Pump 30 is suspended via metallic framing 32 which rests on the walls of the furnace bay 34. The furnace bay 34 will receive molten metal from the main furnace 28. In a typical scenario, the molten metal will reside at a level such as indicated by the bath level (BL, see FIG. 3) throughout the furnace 28 and furnace bay 34. As used herein, the bath level height will refer to the gravity influenced top surface of the molten metal as it lies within the main furnace 28 and in furnace bay 34. The bath level can vary depending upon the quantity of molten aluminum present in the furnace at any particular time but usually will be above the lowest extent of the pump 30 and below the upper extent of the walls forming furnace bay 34.

A motor 35 (see FIGS. 2 and 3) rotates a shaft 36 and the appended impeller 38. Motor 35 has been omitted from FIG. 1 to facilitate the illustration of a flux introduction apparatus as described below. A refractory body 40 forms an elongated generally cylindrical pump chamber or tube 41. The refractory body can be formed, for example, from fused silica, silicon carbide or combinations thereof. Body 40 includes an inlet 43 which receives impeller 38. Preferably, bearing rings 56 are provided to facilitate even wear and rotation of the impeller 38 therein. In operation, molten metal is drawn into the impeller through the inlet (arrows) and forced upwardly within tube 41 in the shape of a forced ("equilibrium") vortex. At a top of the tube 41 a volute shaped chamber 42 is provided to direct the molten metal vortex created by rotation of the impeller outwardly into trough 44. Trough 44 can be joined/mated with additional trough members or tubing to direct the molten metal to its desired location such as a casting apparatus, a ladle or other mechanism as known to those skilled in the art. An apparatus for flux introduction 45 (only shown in FIGS. 1 and 5) is positioned in this region. Apparatus 45 can be generally located anywhere from its depicted location to downstream at point X.

Although depicted as a volute cavity, an alternative mechanism could be utilized to divert the rotating molten metal vortex into the trough. In fact, a tangential outlet extending from even a cylindrical cavity will achieve molten metal flow. However, a diverter such as a wing extending into the flow pattern or other element which directs the molten metal into the trough may be preferred. This would not change the installation of the flux introduction apparatus in this region.

Figure 4:
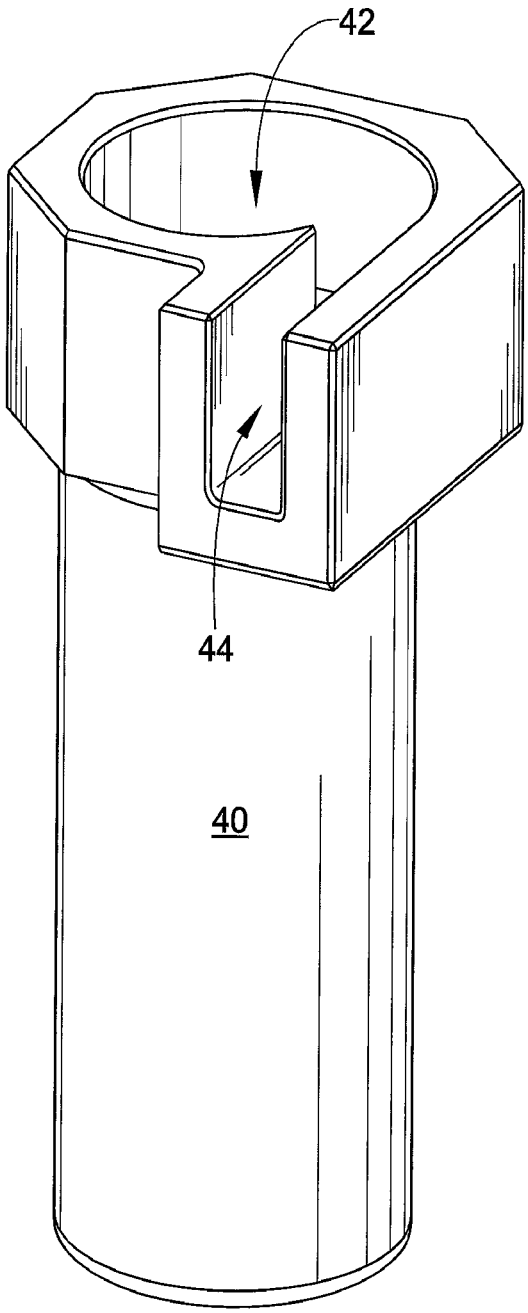
FIG. 4 is a perspective view of the pumping chamber.
Figure 6:
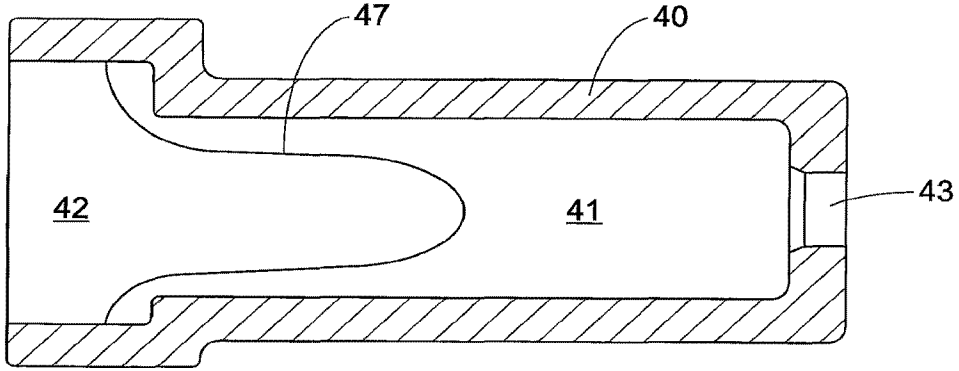
FIG. 6 is a view along the line 6-6 of FIG. 5.
Figure 5:
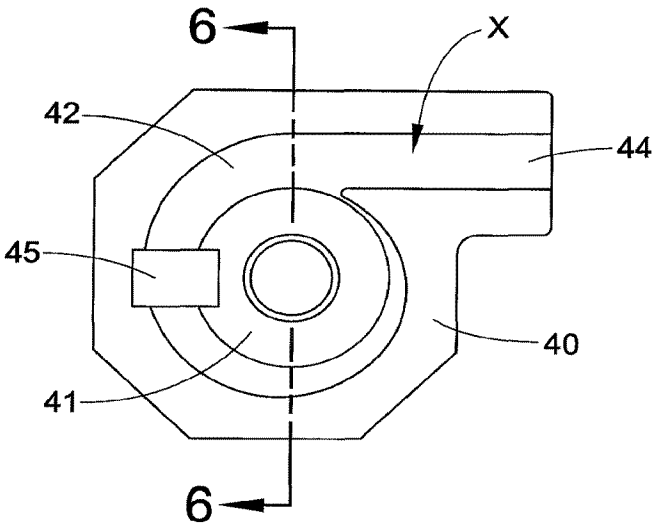
FIG. 5 is a top view of the pumping chamber.

Turning now to FIGS. 4-6, the tube 41 is shown in greater detail. FIG. 4 shows a perspective view of the refractory body. FIG. 5 shows a top view of the volute design and FIG. 6 a cross-sectional view of the elongated generally cylindrical pumping chamber. FIG. 5 provides an illustration of the range of locations for fluxing apparatus 45. These views show the general design parameters where the tube 41 is at least 1.1 times greater in diameter, preferably at least about 1.5 times, and most preferably, at least about 2.0 times greater than the impeller diameter. However, for higher density metals, such as zinc, it may be desirable that the impeller diameter relative to pumping chamber diameter be at the lower range of 1.1 to 1.3. In addition, it can be seen that the tube 41 is significantly greater in length than the impeller is in height. Preferably, the tube length (height) is at least three times, more preferably at least 10 times, greater than a height of the impeller. Without being bound by theory, it is believed that these dimensions facilitate formation of a desirable forced ("equilibrium") vortex of molten metal as shown by line 47 in FIG. 6.

Figure 7:
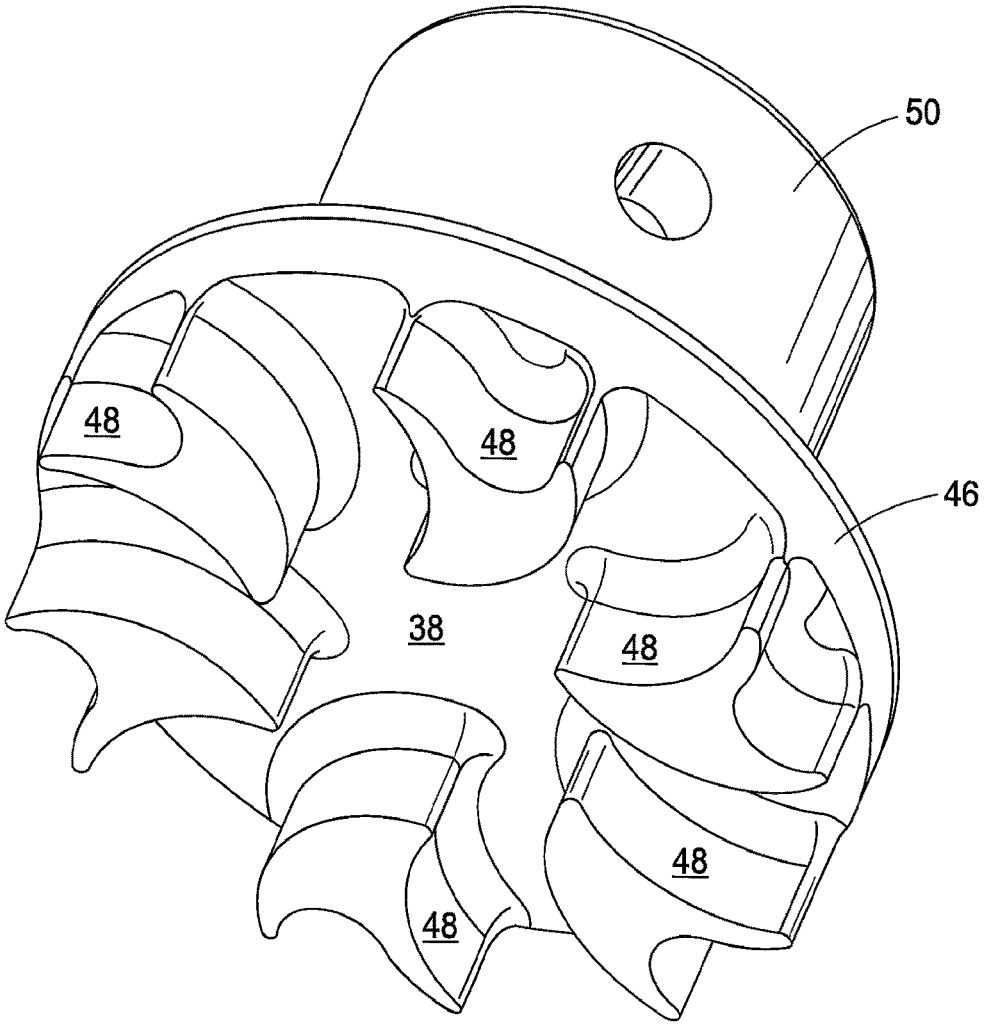
FIG. 7 is a perspective view of the impeller top section.
Figure 8:
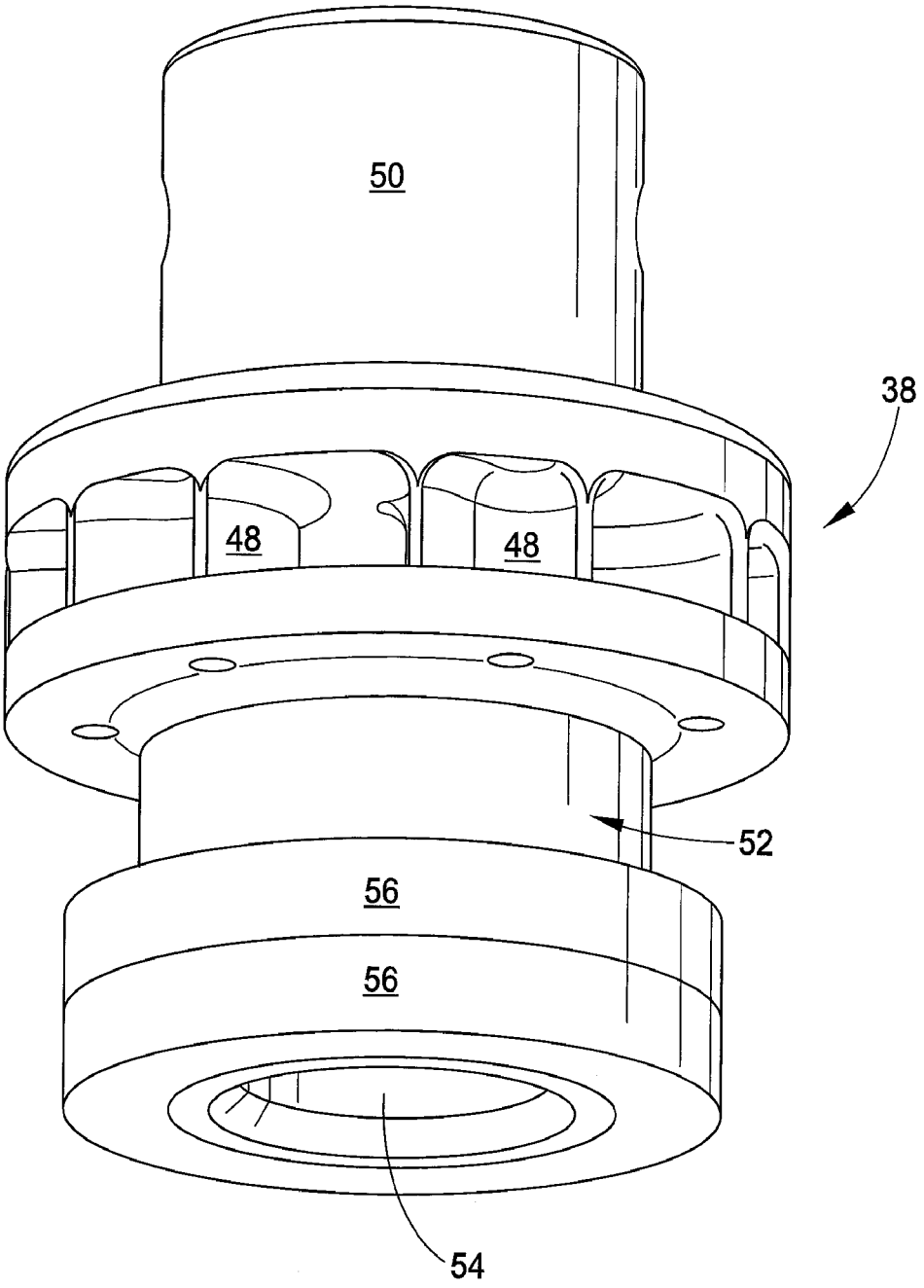
FIG. 8 is a perspective view of the assembled impeller.

FIGS. 7 and 8 depict the impeller 38 which includes top section 46 having vanes 48 supplying the induced molten metal flow and a hub 50 for mating with the shaft 36. In its assembled condition, impeller 38 is mated via screws, bolts or pins/cement to an inlet guide section 52 having a hollow central portion 54 and bearing rings 56. The impeller can be constructed of graphite or other suitable refractory material. It is envisioned that any traditional molten metal impeller design would be functional in the present overflow vortex transfer system.

Figure 9:
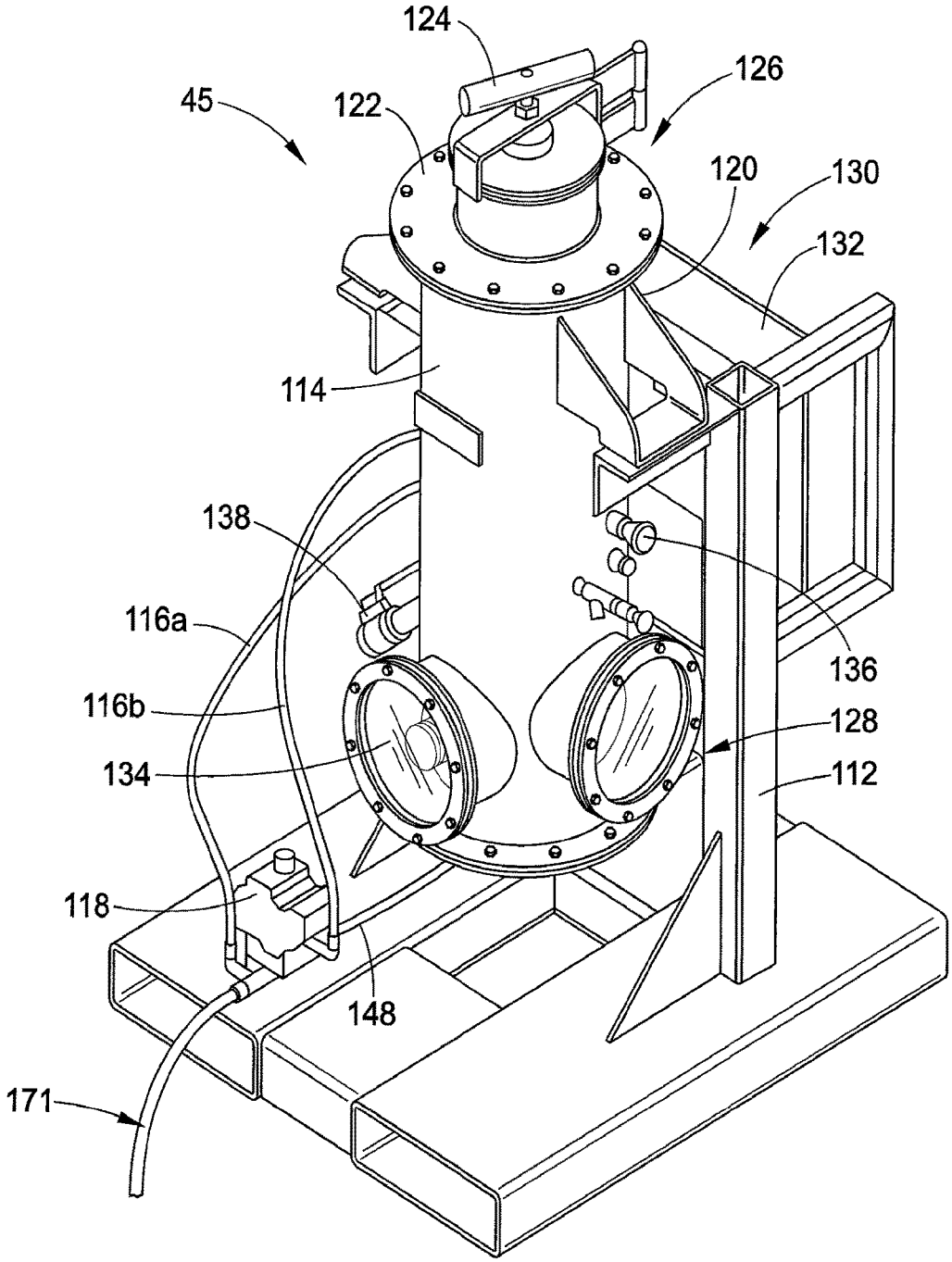
FIG. 9 is a perspective view of a flux injection assembly.

With reference to FIG. 9, an exemplary flux injector assembly 45 is shown in detail. The fluxing apparatus 45 is the type depicted in International Application Publication WO 2012/170604, herein incorporated by reference. Assembly 45 is supported by a structural base 112 that maintains the flux injector assembly 110 in an upright position. As used herein, the term "flux" may be used to refer to a granulated particulate. An exemplary grain size of a fused flux ranges between about 1 mm to about 6 mm. The present apparatus is also suitable for use with blended flux compositions. Exemplary flux material compositions can include manganese and potassium chloride, flourides, and mixtures thereof.

The flux injector assembly 110 includes a pressurized tank 114 in communication with an isolation mechanism 118. In one embodiment, the isolation mechanism 118 is secured to the structural base 112 and configured to isolate the tank 114 from a flow of independent direct inert gas flow to lance that can be disposed in the molten metal flowing within volute chamber 43 or trough 44 (not shown). Moreover, mechanism 118 includes a pneumatic valve to control pressure within the tank 114 and prevent molten liquid backflow from entering the hollow shaft.

The pressurized tank is a generally sealed enclosure with cylindrical body 120 having an opening 122 closed via a secured cap 124 at a first end 126 and a second end 128 that is oppositely disposed from the first end 126. In one embodiment, the opening 122 is configured to receive flux and includes a screen to prevent foreign material or clumps of flux from entering the tank 114. The pressurized tank 114 is adapted to store an amount of flux under a controlled pressure. A controller 130 such as a programmable logic controller (PLC) computer based electric and gas control panel is provided in an enclosure 132. In one embodiment, the controller 130 is mounted to the structural base 112. However, the controller 130 can be provided at a location remote from the structural base 112. The controller 130 can be in communication with the motor driving molten metal pump 30 and with various sensors to determine molten metal levels and/or flow rates or volumes within the pump tube 41 and/or the trough 44. The controller can similarly be located remote to the flux injection assembly 45. Furthermore, the controller can be associated with the pump and in communication with the flux injection assembly.

The pressurized tank 114 can be provided with at least one sight window 134 on the cylindrical body 120 for visual verification of the internal operation of the assembly 110. More particularly, the sight window 134 allows a user to inspect the flow of flux therein and to identify properly working components within the tank 114. In one embodiment, the pressurized tank 114 is designed to operate at a threshold pressure of less than fifteen (15) pounds per square inch gauge (psig). In another embodiment the pressurized tank 114 is operated at a working pressure between two (2) psig and ten (10) psig. The pressurized tank 114 includes redundant pressure relief valves 136 to prevent an unwanted level of pressurization. A tank drain 138 is also provided for emptying or cleaning the assembly 110. In one embodiment, the tank is constructed with a powder coated material to prevent corrosion and clogging due to the interaction of flux and other chemicals.

Figure 10:
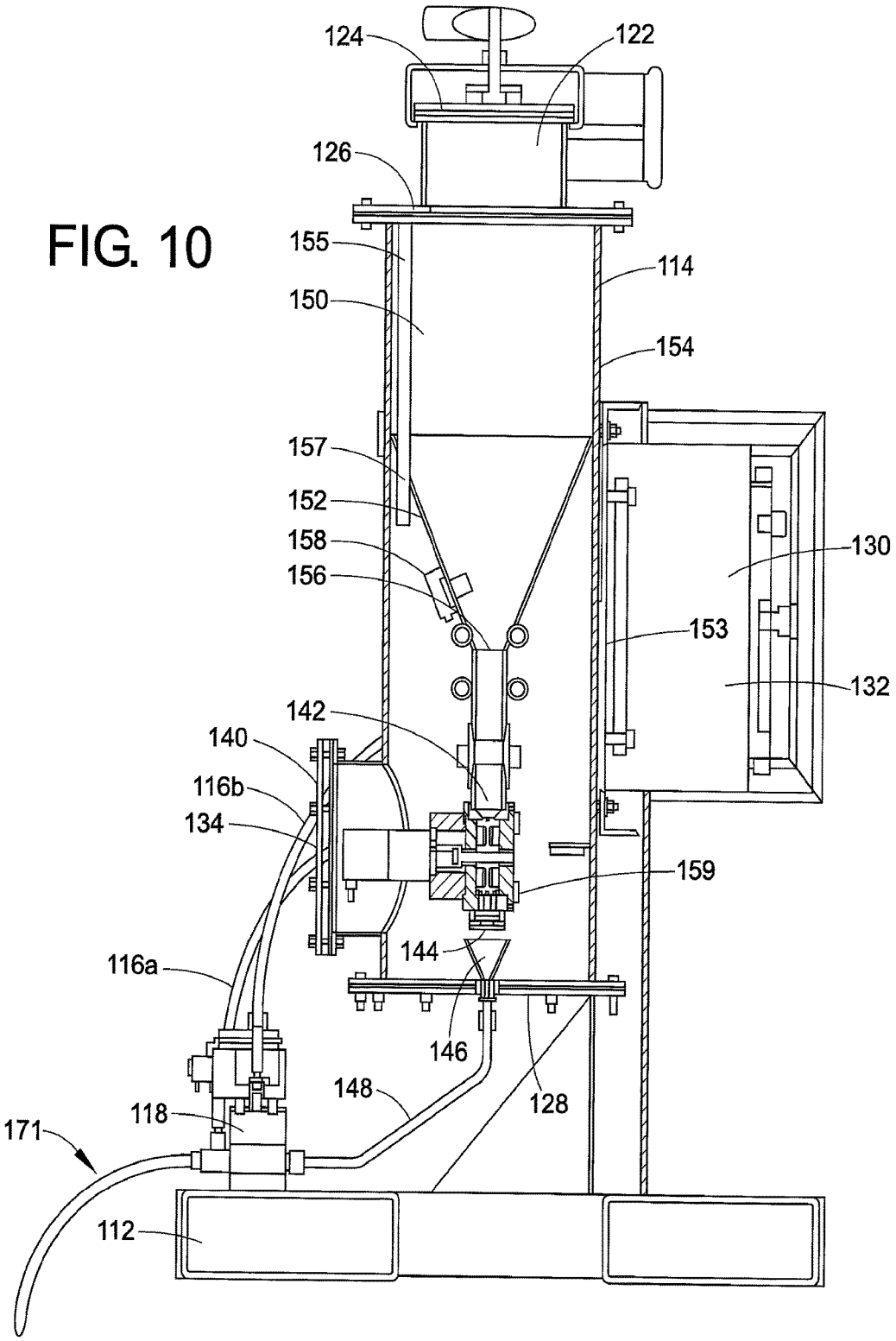
FIG. 10 is a cross sectional side view of the flux injection assembly.

With reference to FIG. 10, the tank 114 includes a feed mechanism 140 positioned within the pressurized tank 114 in communication with a storage tank 150. The feed mechanism 140 is operative to receive flux from the storage tank 150 at a feed inlet 142 and discharge a predetermined amount of flux from a feed outlet 144. The feed outlet 144 is spaced above a collector 146 positioned adjacent the second end 128 of the pressurized tank 114 to receive the predetermined amount of flux from the feed outlet 144. The collector 146 is in connected to a conduit 148 in a sealed manner to allow the transfer of flux from the tank 114 to the isolation mechanism 118 located on the structural base 112. The isolation mechanism 118 can in turn deliver the measured quantity of flux to a lance 171 which directs the flux into the chamber 43 and/or the trough 44. Multiple lances may be employed.

The storage tank 150 is positioned within the pressurized tank 114 adjacent the opening 122 at the first end 126 of the pressurized tank 114 such that additional flux can be provided through the opening 122. The cap 124 is provided at the opening 122 to provide a sealed fit to prevent moisture from accumulating within the tank 114 and to prevent excess flux and fumes associated with the flux to be released from within the storage tank 150. In one embodiment, the storage tank 150 includes a conical shaped base 152 that abuts an inner wall 154 of the tank 114. The storage tank 150 is defined by the area within the inner wall 154 between the first end 126 and the conical shaped base 152. The conical shaped base 152 is configured to allow flux to accumulate at a base aperture 156 that is in communication with the feed inlet 142 of the feeding mechanism 140. The storage tank 150 can include an equalization tube 155 in fluid communication with lower portion 157 of the pressurized tank 114 to allow pressure equalization while preventing unwanted flux transfer. In one embodiment, the storage tank 150 is adapted to contain approximately 100 pounds (45.36 kilograms) of flux.

The at least one sight window 134 allows a user to view the feed mechanism 140 as it operates within the pressurized tank 114. Additionally, hoses **116*a* and 116*b* are adapted to communicate between the isolation mechanism 118 and a gas/pneumatic controller (not shown). Hose 116*a* is a gas bypass line for inert gas flow wherein hose 116*b* is a pneumatic control supply line to actuate a valve in the isolation mechanism 118. The controller 130 is configured to control the level of pressure within the tank 114 and to identify and relay an alarm signal or audible sound to indicate an over pressurization condition of the tank 114. The over pressurization alarm signal can indicate the existence of shaft clogging within the system, downstream from the isolation mechanism 118, particularly in conduit 148**.

The controller 130, (such as a computer) is adapted to monitor and operate the flux injector assembly 110. The controller 130 can manipulate the feed mechanism 140, isolation mechanism 118 and adjust the level of pressure within the pressurized tank 114. The controller 130 manipulates the feed mechanism 140 to provide a predetermined amount of flux from the inlet 142 to the outlet 144 and will be more fully described herein. A first optic sensor 158 is provided adjacent the base aperture 156 to monitor the level of the flux in the storage tank 150. The optic sensor 158 sends a signal to the controller 130 that indicates the level of flux within the tank 150. Optionally, a second optic sensor 159 can be provided adjacent the feed outlet 144 of the feed mechanism 140 to communicate with the controller 130 to reflect that flux is being transferred through the feed outlet 144.

The controller can provide accurate doses of flux during varying conditions. Moreover, the controller can be simultaneously in control of the pump and the fluxing device. Furthermore, the controller will be cognizant of a ladle size to be filled, molten metal flow rates and metal flux requirements. The fluxing system provides a predicted flow by controlling the speed of impeller pump rotation. A positive feedback loop system is used to control the speed of the pump so that the level and/or flow rate is as programmed. If the level and/or flow rate falls below the set point, the motor speed is increased. These adjustments can be made several times a second and only stop when the level is at the desired level or a preprogrammed min. or max. speed is exceeded. By being able to control the output flow and control the rate of flux introduction, the necessary flux introduction level is predicted and controlled. Moreover, these two features are correlated to achieve a precise level of flux introduction over approximately the entire period of molten metal flow to fill the associated ladle.

Similarly, the controller is programmed to begin the introduction of flux. Moreover, the controller can determine when to initiate the fluxing apparatus based on the time and rate of molten metal impeller initiation and speed. Particularly, it is desirable that flux introduction begins only after (but shortly after) molten metal flow has reached the fluxing apparatus location. Furthermore, the controller will be capable of determining the size of the ladle and calculating a desired level of flux introduction. The controller can determine a flow rate of molten metal and estimate a fill time at that rate for molten metal flow. The desired flux quantity can be spread over that period for a homogenous introduction.

Figure 11:
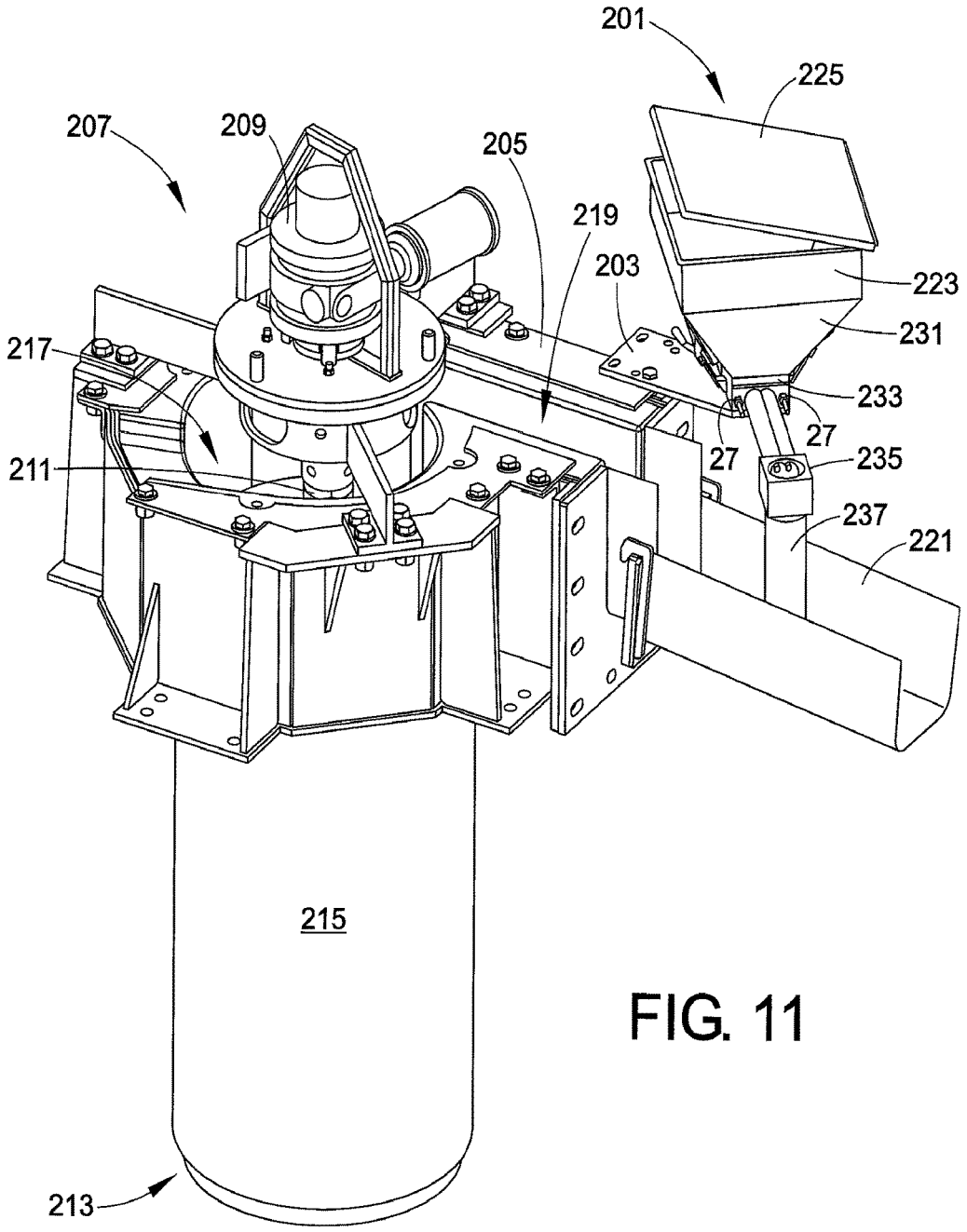
FIG. 11 is a perspective view of an alternative flux introduction molten metal transfer system.
Figure 12:
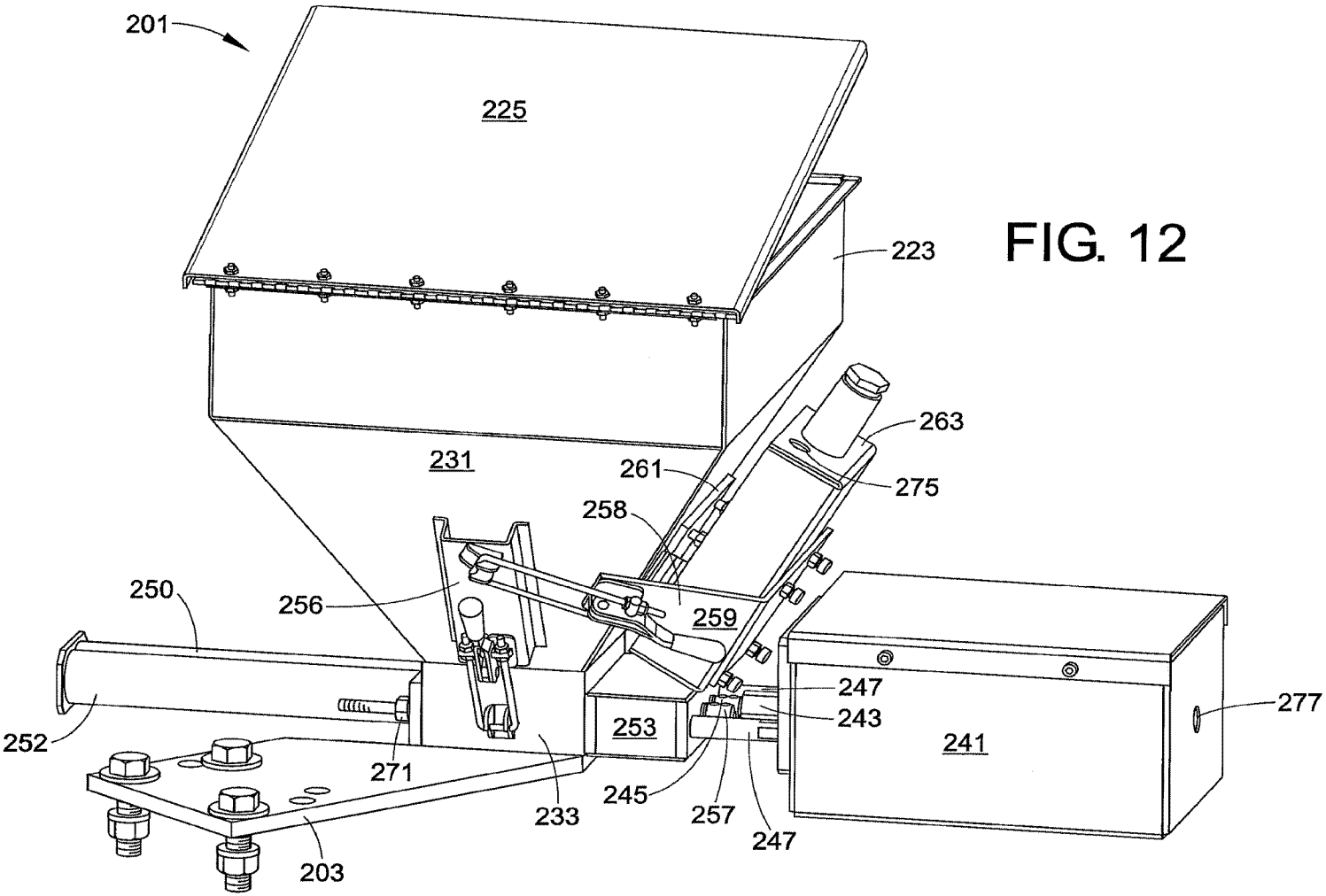
FIG. 12 is an enlarged view of the fluxing apparatus of FIG. 11.
Figure 13:
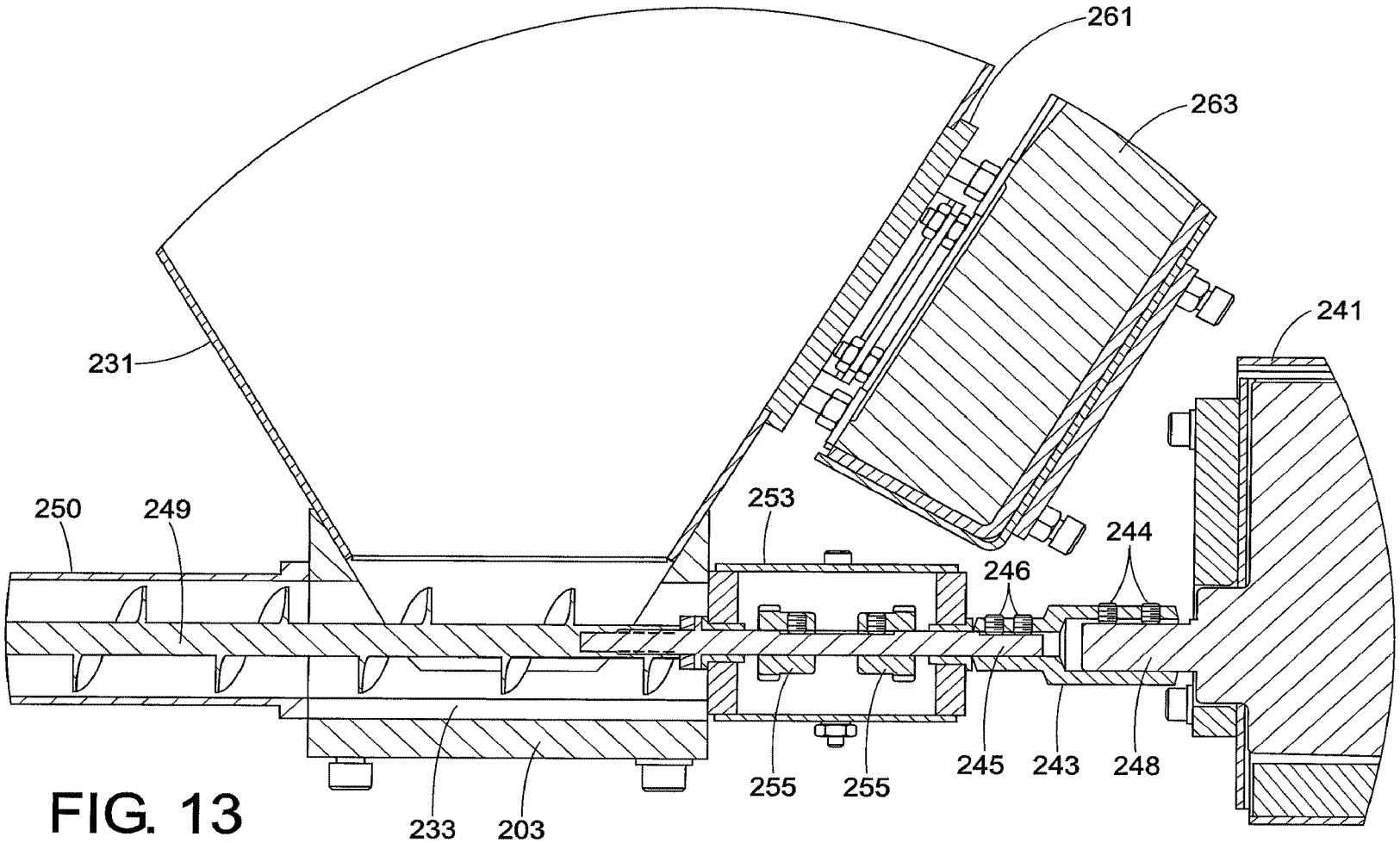
FIG. 13 is a cross-section view of the apparatus of claim 12.

Referring now to FIGS. 11-13, an alternative flux feeding apparatus 201 is depicted. The flux feed apparatus 201 includes a support plate 203 secured to the motor mount structure 205 of the overflow transfer pump 207. Overflow transfer pump 207, is similar to the type depicted hereinbefore, including a motor 209 coupled to a drive shaft 211 which is secured to an impeller (not shown) disposed at a base end 213 of elongated pump tube 215. Rotation of the shaft and impeller within pump tube 215 results in the formation of a vortex of molten metal which rises upwardly within the tube 215 where it is received in a volute chamber 217. A rotational flow of molten metal within volute chamber 217 is created with molten metal exiting through outlet 219 to launder 221. Flux is introduced into the molten metal flowing through launder 221 from the flux feed apparatus 201.

It is noted herein that the flux feed apparatus can alternatively be located such that the flux is introduced into the outlet 219 or within the volute chamber 217 or into a top of tube 215.

The flux feed apparatus 201 includes a hopper chamber 223 covered by a lid 225. Hopper chamber 223 can include an inverted truncated pyramidal section 231 which helps to funnel flux particulate to a feed section 233. Flux is driven from the feed section 233 via a drive screw (or multiple drive screws) into an elbow connection 235 in communication with a gravity feed tube 237. Flux exits the gravity feed tube 237 and is deposited on the molten metal flowing within launder 221.

In certain embodiments, it may be beneficial that gravity feed tube 237 terminate at a level above the molten metal surface within launder 221 such that a gas feed is not required and the prior art short comings of subsurface introduction devices are avoided, such as clogging and/or freezing of molten metal therein.

With specific reference to FIGS. 12 and 13, feed mechanism 201 includes a motor housing 241 within which a drive motor (not shown) is disposed. The drive motor can be, for example, a Bison gear motor of 1/20 horse power having a gear reduction of 12.9:1. The drive motor output shaft 248 is secured via a drive coupling 243 to a first drive connector 245. Set screws 244 are provided to facilitate the securement of the drive coupling 243 to the motor output shaft 248. Set screws 246 are similarly provided between the drive coupling 243 and the first drive connector 245.

Motor housing 241 is secured to the remainder of flux feed apparatus 201 by a pair of support arms 247. The support arms 247 extend from the motor housing 241, through a gear box 253, through hopper feed section 233, and are secured on a second end via nuts 271.

A first conveyor screw 249 is received within a screw passage 250 which can optionally terminate in an outlet for flux to be dribbled into the desired location of the flowing molten metal or secured to the elbow 235 and gravity feed tube 237, as shown in FIG. 11.

The first drive connector 245, as driven by the drive coupling 243, is received within the gear box 253. Gears 255 are provided to link first drive connector 245 with a second drive connector 257 (only the end thereof is visible as it protrudes from the gear box 253 in FIG. 12). Each of the drive connectors 245 and 257 are threadedly mated to conveyor screws, only screw 249 is visible. However, it is noted that the twin conveyor screws can have a mated relationship between their respective vanes. The conveyor screws cooperate to push flux from where it is received in feed section 233 of flux hopper 223 into the cooperative twin screw passages 250 and 252. Twin screws may be beneficial as a mechanism for keeping the feed apparatus relatively free of buildup. The flux feed apparatus 201 components can be releasably assembled via the use of releasable clamps such as the Destako style clamp 256 joining hopper section 231 to feed section 233 and a similar clamp 258 joining hopper section 231 to a bracket 259 securing sensor 263. Advantageously, this facilitates easy cleaning and maintenance of the hopper assembly.

Flux hopper 223 can be provided with a window 261, and a sensor 263 positioned adjacent to the window 261, to facilitate the monitoring of flux levels within the flux hopper 223. The depicted sensor is a capacitance sensor. However, an optical sensor, a laser sensor, or any other type of sensor known to the skilled artisan is equally applicable. Furthermore, it is feasible that a simple viewing window could be monitored by an individual.

Each of sensor 263 and motor housing 241 can include a passage 275 and 277 respectively, suitable for receiving a power line and/or a connection between with the controller (see 130 in FIG. 10 as an example). More particularly, such an interconnection can facilitate the cooperative functioning of the flux feed speed with the molten metal flow rate. Similarly, such an interconnection can facilitate the start of the flux feed gear motor at a predetermined time after the initiation of the molten metal pump, such that flux is introduced only when an appropriate flow rate of molten metal is occurring. Similarly, the gear motor can be halted before the corresponding cessation of molten metal pump motor operation, such that flux feed does not continue after molten metal flow has been terminated. Moreover, premature or delayed flux introduction can be wasteful and damage the associated equipment.

It is further envisioned that the flux injection assembly can be an alternative device such as a spinning wheel or other apparatus that facilitates the introduction of a fixed quantity of flux over a predetermined period of time. In short, the specific mechanics of the fluxing apparatus may not be critical to the success of the process. In this regard, a simple gravity feed flux delivery apparatus (as opposed to gas injection) that can dispense a measured quantity of flux can be used.

Figure 14:
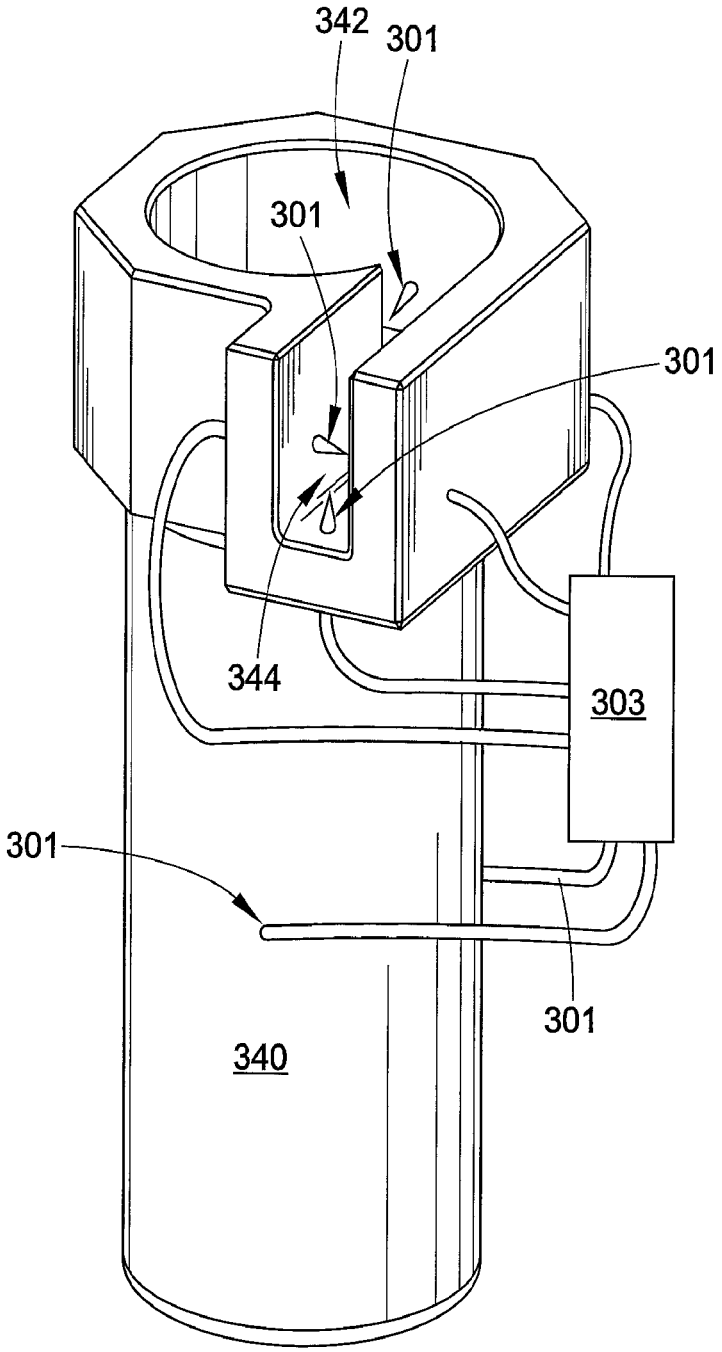
FIG. 14 is a perspective view of a gas introduction apparatus.

In addition, as shown in FIG. 14, it is envisioned that degassing can be performed in elongated tube 340, volute chamber 342 and/or the trough 344. For example, inert gas can be introduced via one or a plurality of lances 301. With respect to introduction into elongated tube 340, it may be desirable that gas introduction is at a level above the molten metal bath level BL (see FIG. 3). Lances 301 are in fluid connection with a controlled gas introduction source 303 of the type often used in molten metal processing apparatus. Alternatively, or in addition, the inert gas can be introduced down the shaft 336 for introduction via the impeller 338. For example, a hollow shaft and gas introduction device of the type disclosed in U.S. Pat. No. 8,178,036, herein incorporated by reference, could be applied to the shaft impeller system of the present molten metal pump 330. However, it is anticipated that gas source 303 and/or the gas control apparatus associated with feeding gas to a shaft/impeller assembly would be in communication with at least one of a fluxing apparatus and/or pump motor controller such that the level of gas introduction can be adjusted based on molten metal flow rates and/or volumes.

It is also envisioned that the gas source 303 (or an alternate gas source) could be employed to deliver an inert gas to the chamber 342 and optionally the trough 344 to provide a protective float-cover gas. Moreover, the inert float-cover gas can provide a barrier to prevent undesirable oxidation.

A further alternative transfer pump is described in U.S. Published Application 2008/0314548, herein incorporated by reference. The system comprises at least (1) a vessel for retaining molten metal, (2) a dividing wall (or overflow wall) within the vessel, the dividing wall having a height H1 and dividing the vessel into a least a first chamber and a second chamber, and (3) a molten metal pump in the vessel, preferably in the first chamber. The second chamber has a wall or opening with a height H2 that is lower than height H1 and the second chamber is juxtaposed another structure, such as a ladle or lauder, into which it is desired to transfer molten metal from the vessel. The pump (either a transfer, circulation or gas-release pump) is submerged in the first chamber (preferably) and pumps molten metal from the first chamber past the dividing wall and into the second chamber causing the level of molten metal in the second chamber to rise (as used herein, this second chamber is at times referred to as an elevation chamber). When the level of molten metal in the second chamber exceeds height H2, molten metal flows out of the second chamber and into another structure such as a launder. The use of a fluxing apparatus and/or inert gas introduction apparatus of the type described previously, to introduce flux and/or gas in the transfer trough (e.g., launder) of the device can provide molten metal treatment advantages. Similarly, it is envisioned that the gas and/or flux may be introduced into the second chamber of the apparatus. The equipment describe above would be suitable for such purpose.

An additional style of pump suitable for use in association with the present disclosure is an electromagnetic pump. Particularly, magnetic repulsion is used to propel a conductor such as aluminum wherein the aluminum acts as the rotor while a coil acts as a stater. The induced magnetic flux propels the aluminum through a pump tube in the direction dictated by the voltage plurality. By changing the applied voltage, the velocity of flow of aluminum can be increased or decreased. In this regard, an electromagnetic pump of the type available from Pyrotek's EMP Technologies of Burton-on-Trent, Staffordshire, UK can be utilized to provide elevated molten metal which can be treated in association with the present disclosure. U.S. Pat. No. 5,350,440, herein incorporated by reference, provides a description of the utilization of an electromagnetic pump in association with a furnace containing molten aluminum.

Another mechanism suitable for use in association with the present disclosure is equipment which displaces molten metal such as aluminum within a metering vessel using a compressed gas. For example, the device disclosed in International Application No. WO 99/59752, the disclosure of which is herein incorporated by reference, provides a suitable apparatus for use in association with the present disclosure. It is further noted that pressurized gas apparatus suitable for use with the present disclosure are available from STRIKOWESTOFEN of New Zealand, Mich. More particularly, it is envisioned that these gas displacement devices are suitable for elevating a molten metal for subsequent flux and/or inert gas treatment.

Example

The apparatus depicted in FIGS. 11-13 was evaluated in a typical cast house environment. First, it was determined that 1200 lbs. of molten aluminum transferred to a ladle using an overflow transfer pump without any type of treatment yielded about 10 lbs. of dross having a metal content of about 90%. Second, in a trial using the present flux addition apparatus, about 0.75 lbs. of Pyroflux 115 was added and the dross was reduced to about 3 lbs. in total with an estimated metallic content of only 20-30%.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An apparatus for introducing flux to molten metal residing as a bath in a furnace, said bath of molten metal having a bath surface height, the apparatus comprising an elongated tube surrounding at least one rotating impeller, said tube and impeller disposed in the molten metal bath such that rotation of the impeller creates a flow of said molten metal up the tube to a chamber, said flow of molten metal elevating a portion of the molten metal into the chamber and then into a launder located above said bath surface height, and a device introducing a fluxing agent comprising a powdered or granulated salt of chloride and/or fluoride to the elevated portion of the molten metal in said launder, said apparatus further comprising a controller monitoring and controlling simultaneously at least flux feed rate, and a speed at which said impeller is rotated such that the flux introduction rate is correlated to the impeller rotation speed.

2. The apparatus of claim 1, wherein said flux introduction device comprises a hopper, at least one feed mechanism, and at least one delivery conduit.

3. The apparatus of claim 2, wherein said feed mechanism comprises one of a wheel and a screw conveyor.

4. The apparatus of claim 1, further comprising a flux level sensor adjacent a feed outlet of the device introducing the fluxing agent and communicating with the controller to correlate the rate of flux introduction with the impeller rotation speed.

5. The apparatus of claim 1, wherein said controller is programmed to discontinue flux introduction substantially simultaneously or prior to cessation of molten metal impeller rotation.

6. The apparatus of claim 1, wherein said controller is programmed to discontinue flux introduction substantially simultaneously or prior to cessation of molten metal flow through said launder.

7. The apparatus of claim 1, wherein said controller is programmed to initiate flux introduction after the initiation of the molten metal impeller rotation.

8. The apparatus of claim 2, wherein said delivery conduit comprises a first horizontal component in communication with the feed mechanism, an elbow in communication with the first horizontal component, and a second vertical component in communication with the elbow.

9. The apparatus of claim 1, wherein said device introducing flux includes a support member secured to a motor mount, said motor mount supporting a motor providing rotation of the impeller.

10. The apparatus of claim 1, wherein the fluxing agent comprises potassium chloride or potassium fluoride.

* * * * *